US008256139B2

(12) United States Patent
Morrison et al.

(10) Patent No.: US 8,256,139 B2
(45) Date of Patent: Sep. 4, 2012

(54) METHOD OF REDUCING A RISK OF FIRE IN A LAUNDRY APPLIANCE AND AN APPLIANCE INCORPORATING SAID METHOD

(75) Inventors: John Richard James Morrison, Auckland (NZ); Seth Fischer, Auckland (NZ); Lindsey Jack Roke, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 1269 days.

(21) Appl. No.: 11/718,535

(22) PCT Filed: Nov. 10, 2005

(86) PCT No.: PCT/NZ2005/000301

§ 371 (c)(1),
(2), (4) Date: Dec. 12, 2007

(87) PCT Pub. No.: WO2006/052152

PCT Pub. Date: May 18, 2006

(65) Prior Publication Data

US 2008/0120868 A1 May 29, 2008

Related U.S. Application Data

(60) Provisional application No. 60/626,642, filed on Nov. 11, 2004.

(51) Int. Cl.
*F26B 11/02* (2006.01)

(52) U.S. Cl. ..... 34/595; 34/606; 34/413; 68/18; 68/20

(58) Field of Classification Search ..... 34/595, 34/524, 381, 413, 497, 601, 610, 60; 68/18, 68/20

See application file for complete search history.

(56) References Cited

U.S. PATENT DOCUMENTS

| | | | | | |
|---|---|---|---|---|---|
| 2,727,315 | A | * | 12/1955 | Candor | 34/543 |
| 3,239,945 | A | * | 3/1966 | Cobb et al. | 34/527 |
| 3,733,712 | A | * | 5/1973 | Smith | 34/532 |
| 3,890,719 | A | * | 6/1975 | Braga et al. | 34/572 |
| 4,488,363 | A | * | 12/1984 | Jackson et al. | 34/572 |
| 4,622,759 | A | * | 11/1986 | Abe et al. | 34/546 |
| 5,187,879 | A | * | 2/1993 | Holst | 34/261 |
| 5,321,897 | A | * | 6/1994 | Holst et al. | 34/260 |
| 5,852,881 | A | * | 12/1998 | Kuroda et al. | 34/527 |
| 6,968,632 | B2 | * | 11/2005 | Guinibert et al. | 34/602 |
| 2004/0055176 | A1 | * | 3/2004 | Yang et al. | 34/549 |
| 2004/0200093 | A1 | * | 10/2004 | Wunderlin et al. | 34/606 |
| 2007/0186440 | A1 | * | 8/2007 | Guinibert et al. | 34/603 |
| 2007/0220776 | A1 | * | 9/2007 | Guinibert et al. | 34/603 |
| 2008/0120868 | A1 | * | 5/2008 | Morrison et al. | 34/572 |

FOREIGN PATENT DOCUMENTS

DE 3733712 A1 * 4/1989

(Continued)

*Primary Examiner* — Stephen M. Gravini
(74) *Attorney, Agent, or Firm* — Clark Hill PLC

(57) ABSTRACT

A method of reducing the risk of fire or containing fire in a laundry appliance and an appliance incorporating said method. The appliance includes a sensor means capable of sensing an abnormal fault condition indicative of an increased fire risk or a fire within the appliance drum. In response to sensing the abnormal fault condition, the appliance controller enters a fire containment cycle which rotates the drum at a tumbling speed.

32 Claims, 2 Drawing Sheets

FOREIGN PATENT DOCUMENTS

| | | | |
|---|---|---|---|
| DE | 100 25 204 | | 9/2001 |
| DE | 100 25 205 | | 9/2001 |
| JP | 2-309998 | | 12/1990 |
| JP | 4-64396 | | 2/1992 |
| JP | 09056995 A | * | 3/1997 |
| JP | 10-43495 | | 2/1998 |
| JP | 10-249098 | | 9/1998 |
| JP | 11-319395 | | 11/1999 |
| JP | 2001-38088 | | 2/2001 |
| WO | 03/087459 | | 10/2003 |

* cited by examiner

METHOD OF REDUCING A RISK OF FIRE IN A LAUNDRY APPLIANCE AND AN APPLIANCE INCORPORATING SAID METHOD

This application is a National Phase filing of PCT/NZ2005/000301, having an International filing date of Nov. 10, 2005, which claims priority of U.S. provisional application Ser. No. 60/626,642 having a filing date of Nov. 11, 2004.

BACKGROUND TO THE INVENTION

1. Field of the Invention

The present invention relates to laundry appliances, in particular consumer laundry appliances for washing and/or drying of damp textile articles, such as items of clothing, towels and bed linen.

2. Background

It is known that a number of common substances such as oils (for example linseed oil) and other resins, can ignite spontaneously under certain circumstances, when not handled with proper care. Spontaneous combustion can occur when rags, towels, clothing or other textiles wetted with such oils or resins, auto-oxidise and generate enough heat to reach the ignition temperature of the textiles. Spontaneous combustion can occur without a flame, spark or other external ignition source and can occur under ambient conditions without an additional heat source. The provision of an additional heat source may aid ignition and may also initiate spontaneous combustion of materials which may not ordinarily be vulnerable to this process at normal ambient temperatures. In cases where additional heat is provided, (for example, cotton clothing heated in by an external heat source in a laundry clothes dryer) the increase in ambient temperature increases the rate of oxidisation. When the heat produced by the auto-oxidisation reaction is produced more quickly than it can be lost to the surroundings, it builds up and the temperature may reach the ignition point of the surrounding material. Even if the heat build up is not sufficient to initiate spontaneous combustion, the textiles may become charred and/or produce smoke.

Factors important in the determination of whether an auto-oxidisation reaction will result in dangerous heating and/or spontaneous ignition, are the rate of heat generation, the oxygen supply to the oxidisation reaction and the insulative properties of the surroundings. In order for spontaneous combustion to occur, the air supply must be sufficient to provide enough oxygen to permit the oxidisation process to proceed, but not so great that the heat produced by the reaction is reduced (for example, by convection) to the point where sufficient heat build up cannot occur. Auto-ignition of textiles will most commonly occur where the oils are dispersed in a thin layer through a rag or piece of clothing because the surface area of the oil wetted area is maximised.

The phenomenon of spontaneous combustion of textile articles wetted with fuels known to be vulnerable to this event, presents an obvious risk for laundry appliances where such textile articles are loosely packed in a pile and may be additionally heated. These conditions are well known risk factors influencing the likelihood of dangerous overheating and/or which may then lead to catastrophic loss of property or loss of life due to fire. A higher risk of damage may be present where the user of an appliance such as a clothes dryer, interrupts the normal cycle by opening the door, thereby preventing a cool down cycle (where the heating element is deenergised) from being completed.

Passive safety measures such as smoke detectors, located in rooms and buildings are a known method of sensing an abnormal condition such as a fire. In response to sensed smoke, a warning alarm may be activated to alert people of danger and appropriate action can be taken early. There are to our knowledge, no active or passive safety measures known in the prior art for alerting the presence of a dangerous fault condition such as described above, in the field of laundry appliances.

SUMMARY OF THE INVENTION

Accordingly it is an object of the present invention to provide a laundry appliance which goes some way to overcoming the above problems or to at least provide the public with a useful choice.

In a first aspect the invention may broadly be said to consist in a laundry appliance comprising:

a rotatable laundry holding drum, rotatable about a substantially non-vertical axis, a motor, connected directly or indirectly with said drum to drive rotation of said drum, at least one sensor for sensing an abnormal fault condition, and initiating a fault signal in response thereto control means configured to control operation of said motor and connected to said at least one sensor, wherein in response to receiving at least one said fault signal, said control means causes said motor to rotate said drum at a predetermined rotational tumbling speed capable of tumbling a textile load within said drum.

Preferably said appliance includes an air movement means for moving a flow of air through the interior of said drum, and said controller is further configured to de-activate said air movement means in response to a said fault signal.

Alternatively said appliance includes an air movement means directly coupled to said drum for moving a flow of air through the interior of said drum, and said air movement means is operable in a high flow direction and a low flow direction, and wherein said rotation of said drum at said tumbling speed is in said low flow direction.

Preferably said tumbling speed is less than 50 rpm.

Preferably said predetermined tumbling speed is such that a textile load within said drum is caused to tumble at a rate significantly slower than a maximum tumbling speed of said drum.

Preferably said predetermined tumbling speed is between approximately 5 rpm and approximately 30 rpm.

Preferably said predetermined tumbling speed is approximately 20 rpm.

Preferably said appliance further includes a heating means for heating a flow of air moving through said drum, said control means is further configured to de-energise said heating means as said drum is rotated at said tumbling speed.

Preferably said control means in response to receiving said at least one fault signal, terminates a current cycle and starts a fire containment cycle which causes said motor to rotate said drum at a predetermined rotational tumbling speed.

Preferably said at least one sensor includes a smoke detector, and said abnormal fault condition is the presence of smoke proximate to said detector.

Alternatively wherein said at least one sensor means includes a temperature sensor, and said abnormal fault condition is a temperature greater than a predetermined threshold temperature proximate to said temperature sensor.

Preferably wherein said at least one sensor means is located proximate an exhaust passage, said exhaust passage being in fluid connection with said drum.

Preferably said at least one sensor is located proximate to an inlet of said exhaust passage, and said predetermined threshold temperature is approximately 70° C.

Preferably said predetermined threshold temperature is between approximately 70° C. and 100° C.

Preferably wherein, said at least one sensor is located proximate to an outlet of said exhaust passage, and said predetermined threshold temperature is greater than approximately 50° C.

Preferably said appliance includes a top deck and said at least one sensor is located in said top deck of said appliance, and said predetermined threshold temperature is between approximately 80° C. and approximately 110° C.

Alternatively wherein said threshold temperature is a predetermined temperature difference between a temperature measured by said at least one sensor and ambient temperature.

Alternatively said appliance measures and stores temperature data and time elapsed data of a current cycle, and said fault signal is generated by comparing said current cycle data, to stored reference data and generating said signal if said current cycle data deviates from said stored reference data by a predetermined degree.

Preferably said at least one sensor is located on an underside of a lid or cover of said appliance.

Preferably said laundry appliance further includes an audible alarm, and wherein said controller is configured to energise said alarm in response to receiving said fault signal.

Preferably said appliance includes at least one further sensor means to sense further appliance condition parameters, and said control means is capable of receiving a signal from said further sensor means, said signal being representative of said appliance condition parameters, and said predetermined threshold depends on said sensed appliance condition parameters.

Preferably said appliance condition parameters are any one of:

a) a door or lid of said appliance is open or closed b) said drum is open or closed c) ambient temperature In a second aspect the invention may broadly be said to consist in a method of reducing a risk of fire in a laundry appliance comprising:

sensing a parameter related to increased fire risk within said appliance, determining if said parameter reaches a predetermined threshold, said threshold being indicative of an increased fire risk within said appliance, rotating a laundry drum of said appliance at predetermined rotational speed capable of tumbling a laundry load within said drum.

Preferably said appliance includes an air movement means for moving a flow of air through said drum and said method further includes deactivating said air movement means.

Preferably wherein said appliance includes a heating means for heating a flow of air moving though said drum and said method further includes de-energising said heating means.

Alternatively said appliance includes an air movement means directly coupled to said drum for moving a few of air through said drum, wherein said air movement means includes a high flow direction and a low flow direction, and said rotation of said drum at said tumbling speed is in a reverse direction.

Preferably said tumbling speed is less than approximately 50 rpm.

Preferably said pre-determined tumbling speed is such that a textile within said drum is caused to tumble at a rate significantly slower than a maximum tumbling speed of said drum.

Preferably said pre-determined tumbling speed is between approximately 5 rpm and approximately 30 rpm.

Preferably sensing of a said parameter related to increased fire risk is a smoke detector means.

Preferably said sensing of a said parameter related to increased fire risk is a temperature sensor.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

Embodiments of the invention will now be described by way of example only, with reference to the accompanying drawings in which.

DETAILED DESCRIPTION

Definitions: Throughout this specification reference is made to preventing fires within an appliance. However it is to be understood that the term 'prevent' is meant to refer to both complete prevention or extinguishment as well as partial inhibiting or containment of a fire which reduces the likelihood of the fire getting out of control. Further, the term 'fire' is also to be understood to refer to an ignited fire as well as a rapid oxidisation reaction short of actual ignition.

In order to implement active measures for inhibiting a fire within the clothes drum of a laundry appliance 1 from developing or progressing out of control, it is first required that the laundry appliance include at least one sensor means for sensing an abnormal condition which is indicative of a fire, or the risk of a spontaneous fire occurring within the appliance. For example, the appliance may be fitted with a temperature sensor or sensors, to detect elevated temperatures at different locations within the appliance, and/or sensor(s) to detect smoke or other combustion products within the appliance. For this purpose, it is envisaged that known temperature sensors such as thermocouples, bimetallic strips, thermistors (PTC or NTC), IC's, resistance temperature detectors (RTD) or other suitable temperature sensing technologies may be utilised. Similarly, sensors suitable to detect smoke or other combustion products may also be selected from those well known in the industry such as photoelectric sensors or ionisation detectors. It may also be preferable to detect an abnormal condition such as a fire, with an infra-red sensor.

In order for the sensor(s) to detect the presence of an abnormal fault condition (indicative of a fire or an increased risk of a fire) and issue a fault signal, it is necessary to locate the sensor(s) in a suitable position or positions within the appliance. Further factors influencing the preferred location for the sensor(s) are: whether the appliance is top loading or front loading, and the configuration of the exhaust vents and/or ducts (if present). It is preferable that temperature sensing occurs at a location sensitive to abnormal temperature increases, but also at a location not so far away from the laundry load to result in an unacceptable delay in the time it takes for a temperature rise to propagate to the sensor location. Similarly for smoke detector type sensors, it is preferable that the sensors are not located so close to the clothes load that proper function is impeded.

Figure 1:
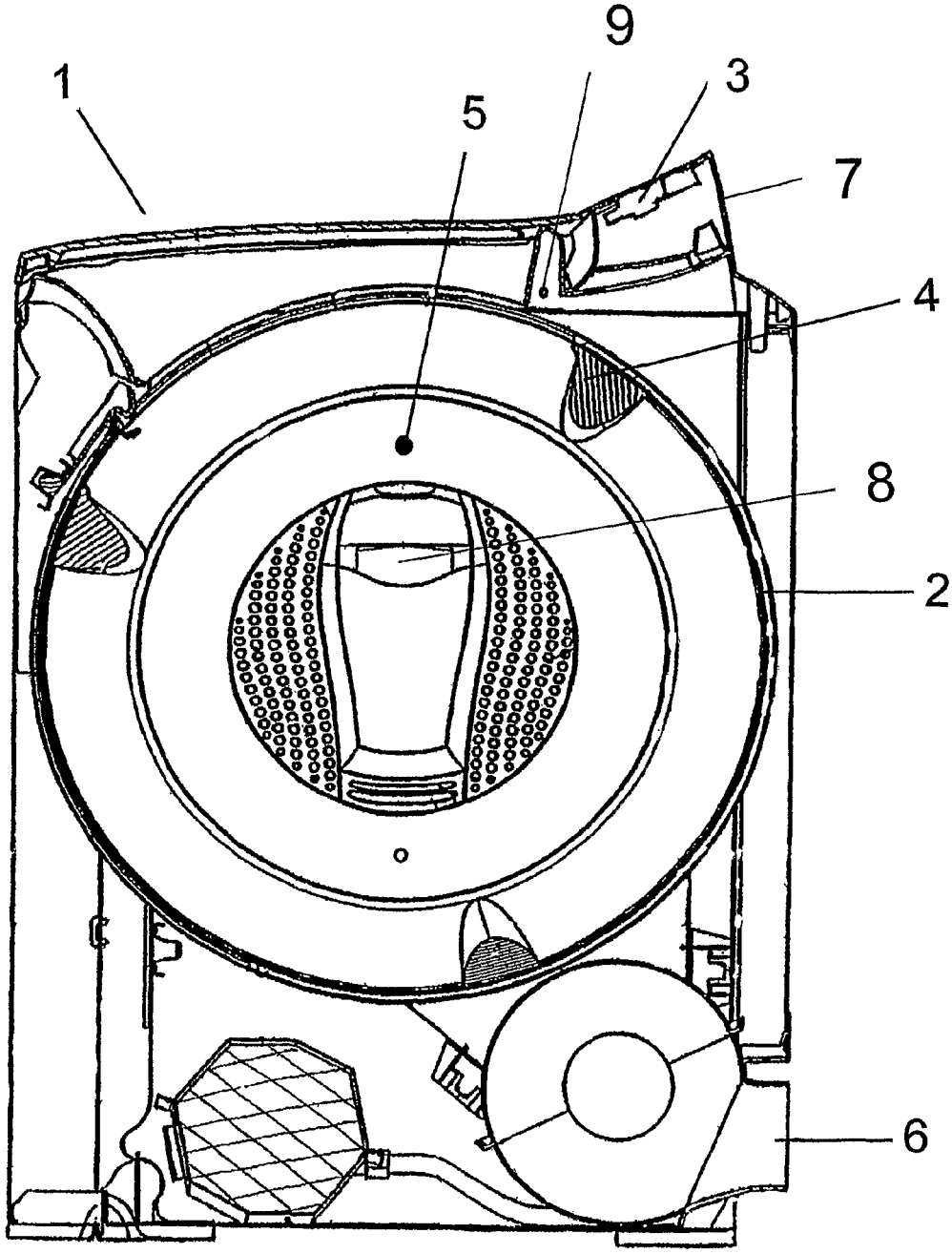
FIG. 1 is cross-sectional elevation of a horizontal axis laundry appliance according to a preferred embodiment of the present invention.

It is also preferred that the abnormal fault condition sensor or sensors are located in a position to which heat and/or smoke will naturally migrate, even when the appliance is not operating. Clothes dryer laundry/kitchen appliances commonly include an exhaust air passage in fluid communication with a rotatable drum. With reference to FIG. 1, a means for sensing an abnormal risk condition is shown located within the drum 2 of a horizontal axis laundry dryer 1 at a location towards an upper end of the appliance drum. In this example, the wall of the drum in which the sensor 5 is mounted, does not rotate and is therefore stationary with respect to the appliance. A further, preferred location of the means for sensing a fault condition, is proximate to an inlet of an exhaust passage 8 of a clothes dryer, and/or in a position relatively high with respect to the drum, such as in the top deck 7, so that rising heat/smoke will flow towards the sensor means 9. Another preferable location for the fault sensor means (in a top loading appliance), is on the under side of the lid above the appliance drum. A further preferable location, is in an outlet of an exhaust passage, where it is common for clothes dryers to have a temperature sensor which monitors changes in exhaust air temperature in order to indicate the end of a drying cycle. These example locations are sufficiently proximate to the load within the drum to quickly sense a fault condition while also being convenient and unobtrusive to the functioning of the appliance. The choice of position(s) for locating the sensor(s), will be influenced by the type of sensor, the type of appliance and also the orientation of the appliance. It is common for laundry appliances (if the type permits) to be mounted upside down on a wall. In such cases, careful consideration of sensor position or alternative positions may be required to ensure effective operation in all appliance configurations. For example, it may be preferable to locate a sensor within the appliance wrapper at a location towards an upper end of the appliance where smoke/heat is likely to migrate.

In determining the sensed criteria (e.g. predetermined threshold) for an abnormal temperature increase, it will be appreciated that the location of the temperature sensor will be important. It may be possible for the air temperature within a clothes dryer drum to reach high temperatures under normal conditions. Therefore, if a temperature sensor located within the drum or proximate an inlet of an exhaust passage (in fluid communication with the drum) reaches an abnormally high level, it could be inferred that there is an abnormal condition and an increased fire risk due to auto-oxidisation or an actual fire. After reaching this predetermined threshold, the appliance controller 3 may initiate a fire containment/fire prevention cycle. Alternatively, temperature may be sensed at a location further from the drum such as the outlet end of an exhaust passage or in the top deck 7 of the appliance. In this case, the predetermined threshold for assessing the risk of a fire may be lower. It is unusual for temperatures at the outlet end of the exhaust passage of a dryer to significantly exceed approximately 70° C. Therefore an appropriate preferred threshold may be between approximately 60° C. and 150° C. Alternatively, the threshold may be varied by taking into account the normally changing ambient temperature.

It is also known that the temperature of a dryer cycle follows a predictable pattern throughout the complete drying cycle, therefore for any particular dryer design, a person skilled in the art will be able to predetermine a threshold criteria which is indicative of an abnormal fault condition. For example, it is known that the temperature at the outlet of the exhaust passage increases as the laundry load becomes dryer toward the end of the cycle. It is envisaged that the known profile of a particular type of dryer, with an average laundry load, may be used to predetermine a threshold based on a measurement (or calculation) of deviation from the normal expected profile.

It is common in modern laundry appliances to include a controller (which may be electronic or hard-wired) for controlling the appliance functions. In operation, (with reference to FIG. 1) if the laundry appliance controller 3, receives (or calculates) an abnormal fault condition signal from one or more of the fault sensors 5 (indicating a fire risk or a fire), the controller responds by terminating the current appliance program cycle and enters a fire containment cycle. During the fire containment cycle, the controller operates the motor to rotate the drum 2 at a pre-determined slow angular speed, in order that the laundry load tumbles within the drum and may also energise an audible alarm to alert a user to the danger. It is envisaged that the fire containment cycle may be initiated while the appliance is part way through a normal cycle, or alternatively initiated after a normal cycle has finished and at some time subsequent, a fire risk abnormal fault condition develops. For example, the appliance may be stopped by a user before the cool-down cycle is complete, and this may constitute a higher risk situation due to the wash load being idle and at a higher than ambient temperature.

It has been found that a speed of approximately 5 to 50 rpm causes the clothes load at the bottom of the drum to be raised by the vanes 4, until they reach a point where they fall under gravity to a lower position within the drum. This slow rotation sets up a slow beating motion of the load within the drum. The slow rotational speed is preferably slower than the speed at which centripetal force presses and significantly retains the clothes against the inner wall of the drum so that tumbling does not occur. At approximately 10 to 35 rpm the clothes are beginning to tumble at a rate which induces a preferable beating motion. Importantly the tumbling is too slow to significantly aerate the clothes load which may fan the flames further.

It has been found that the slow tumbling of the clothes load is effective for beating out a fire within the appliance drum. Further, where spontaneous combustion has not yet taken place but an auto-oxidisation reaction is occurring within the clothes load, the slow beating and tumbling motion may be effective to dissipate the heat build up within the clothes load, and may prevent the textiles from reaching their ignition temperature. Tangles in the wash load can insulate small areas of the load and promote the auto-oxidisation reaction by not allowing heat build up to adequately dissipate. Tumbling of the wash load can be effective to untangle the load and thereby allow the heat to dissipate and reduce the risk of auto-ignition.

It is preferable that the appliance controller 3 (where a dryer or combination washer/dryer), does not operate its air movement means (fan or pump) during the fire containment cycle. In dryers where a fan is directly coupled and driven with the appliance drum, it is preferred that the controller operate the drum in a reverse direction in order to reduce the efficiency of the directly coupled fan, and thereby reduce the airflow which arises from a given rotational speed. This method is appropriate to fans which have a low flow direction and a high flow direction of rotation dictated by the geometry of the fan. Alternatively, the fan or fans may be de-coupled during the fire containment cycle, or may be configured with a clutch mechanism so that reverse rotation of the drum reduces the airflow caused by the fan. Alternatively the fan or pump can be switched off, if appropriate.

It has been found that the amount of airflow through the drum effects the range of drum rotation speeds at which the present invention is most effective. For example, where the fan is coupled to the drum, higher tumbling speeds may be effective if the air flow through the drum is reduced, by reversing the direction for example. Conversely, where the fan is switched off or de-coupled, higher rotational speeds may be more effective at containing the fire or beating the flames out. These variations suggest that the most effective speed will be dependant on the geometry and configuration of the appliance. Further, a balance needs to be found between airflow that is too high and fans the flames vs. airflow that is insufficient to allow the heat build-up to dissipate.

The normal rotational speed of a large laundry drying appliance such as that disclosed in WO 03/087459 is approximately 47 rpm, while the normal speed of a compact dryer appliance is approximately 53 rpm. These different speeds and drum diameters result in approximately the same peripheral speed. At significantly higher speeds, the laundry load is forced to the outside of the drum without significant tumbling occurring. In the example preferred embodiment shown in FIG. 1, a fan is directly coupled to the drum and therefore rotates with it. In such a configuration, it has been found that a tumbling speed of between 5 and 47 rpm is effective for reducing fire risk and beating out an existing fire. It has also been found that for this type of configuration, a speed of between 10 and 35 rpm is especially preferable.

Due to the nature of auto-oxidisation and spontaneous combustion, the laundry appliance may experience a fire or abnormally high temperature due to auto-oxidisation even if the appliance is not operated. Further, it may be that a clothes load is placed into the laundry appliance and the door/lid left open by the user with the intention of operating the appliance at a later time. In such a situation, it is possible that the clothes load may over-heat and/or spontaneously combust due to an auto-oxidisation reaction of an oil in the clothes load for example. It is common for modern appliances to include standby modes and/or power saving modes where the appliance while not operating is still capable of some basic functions. It is preferable that the appliance of the present invention monitors the fault sensor means even when powered down to standby and remains capable of entering the fire containment cycle in response to a sensed risk. It is envisaged that termination of the fire containment cycle could be allowed to occur based on a number of different criteria. For example, the containment routine could be allowed to continue indefinitely, or until the fault condition is no longer sensed. Alternatively, the containment cycle may be timed, and terminate after a predetermined elapsed time. The cycle may also be allowed to continue for a time period after the fault condition is no longer present for example. Obviously, these methods each have advantages and disadvantages. For example, the absence of a continuing sensed fault condition may be due to fire damage to the sensor rather than the absence of a fire within the drum.

Depending on the configuration of the laundry appliance and its lid/doors, and/or safety standards, the laundry appliance controller may be programmed to react in various ways in response to a sensed fault condition. For example, if the appliance is in a standby mode and the door/lid is open, it may be preferable to only sound an audible alarm in order to attract the attention of a user. In this case it may be preferable not to rotate the drum according to the fire containment cycle described above in order to avoid the danger of users limbs being trapped in the drum, a small child becoming trapped or of burning clothing being ejected from the appliance. A decision not to enter the fire containment cycle may be preferable where the appliance has the capability of automatically closing its lid/door, and thereby creating the potential for unwitting entrapment and danger to the user.

Alternatively, it is envisaged that it may be preferable to execute the fire containment cycle even where the appliance lid/door is left open, or where a risk of entrapment exists. The containment cycle may also include automatically closing the door and/or drum. Many laundry appliances of this type already have controllers and logic routines which are able to close and/or lock the appliance lid/door in order to minimise danger to the user. An example, of an appliance of this type is shown in our application WO 03/087459 which is incorporated into the present application in its entirety by reference. It is envisaged that the same known mechanisms and routines may be utilised at the beginning of the fire containment routine to improve safety. Further, it is envisaged that the predetermined threshold for establishing an abnormal fault condition may vary according to various condition parameters of the appliance. For example, the threshold may vary according to whether the door or lid or drum opening of the appliance is open or closed or what the ambient temperature is or was before the fire. This is so the appliance controller logic can take in to account the extra likelihood of heat build-up that is possible when the lid or door is closed. For example, consider a horizontal axis top loading laundry appliance such as that of WO 03/087459 where a temperature sensor is located in the top deck 7. It will be appreciated that an appropriate predetermined threshold may vary according to whether the controller senses if the lid or drum opening is open or closed. Further, the predetermined threshold may calculated from a combination of factors and sensed data, so that the appliance can more accurately assess the risk of fire and be less sensitive to false positive situations which are undesirable and may result in unnecessary entrapment risks.

Testing of the fire containment invention was carried out using a laundry appliance such as that disclosed in our prior patent application published as WO 03/087459. The results of the tests are summarised below.

Fire Containment—Testing

Method 1

A horizontal axis laundry dryer was loaded with 2.8 kgs of cotton cloth. The cloth was then lit with a propane torch and the fire was allowed to catch hold for approximately one minute before the lid/door of the appliance was closed and the appliance was started without the heater energised. The appliance drum was rotated at approximately 11 rpm in a forwards direction. Alternatively, the drum was rotated in a "reverse" low flow direction.

Results—Upon commencing the rotation of the drum, the amount of smoke exiting from the exhaust quickly reduced. After approximately five minutes, the smoke exiting the exhaust ceased almost entirely. After approximately ten minutes, the experiment was terminated and the appliance opened revealing that the fire was completely extinguished and the appliance had sustained no damage. The results were similar for both directions of rotation.

Note:

Experiments, where linseed oil was used to pre-wet the load, resulted in extinguishment of the fire but ongoing smouldering. The oil did not appear to act as a significant accelerant but did keep the load smouldering. A minor degree of heat damage to the grill was observed.

Method 2

3 series of tests were carried out in a similar manner to method 1 above. The load size was approximately 3 kg and consisted of a mixture of cotton and synthetic textiles. After ignition of the textile load the drum was started and left to run for 10 minutes. At the end of this time period the drum was stopped, opened, and the wash load inspected.

The first series of tests was conducted with the drum running backwards to reduce the efficiency of the coupled fan. Tests were conducted at speeds of 5, 10, 20, 30, and 47 rpm. The results showed substantial extinguishment of the fire in all tests, although the 47 rpm test showed some continued smouldering.

The second series of tests was conducted with the drum running forwards normally. Tests were conducted at speeds of 5, 10, 20, 30, and 47 rpm. The results showed extinguishment of the flames at 5, 10, 20, and 30 rpm, although the 5 rpm and 30 rpm tests were still smouldering a little. At 47 rpm, the fire was not contained and the test was terminated before the 10 minutes elapsed in order to prevent significant damage to the appliance. Presumably, the fan was fanning the flames too much to be effective.

The third series of tests was conducted with the drum running with no fan. Tests were conducted at speeds of 5, 10, 20, 30, and 47 rpm. The results showed extinguishment of the flames at all speeds, although only the 47 rpm test was not smouldering at the end of 10 minutes.

These test results confirm that the effectiveness of the present invention varies according to the geometry and configuration of the appliance. The method is most effective when the right balance between an airflow that is too high and fans the flames vs. airflow that is insufficient to allow the heat build-up to dissipate. The test confirmed that where a fan is present and running backwards or forwards, the most effective speed is toward the middle of the tumbling range (tumbling range is between 0 to 50 rpm), i.e. 5 to 30 rpm, or more specifically 10 to 20 rpm. For appliances without a fan or decoupled fan, the results suggested that higher speeds in the tumbling range may be more effective.

Method 3

Further tests were done with varying load sizes of approximately 1.5 kg and 7.5 kg. These tests showed that the fire containment technique is less effective where the load is very small or very large. This is consistent with the theory that a balance between an airflow that is too high and fans the flames vs. airflow that is insufficient to allow the heat build-up to dissipate, is necessary to maximise the effectiveness. Presumably, at low loads the airflow is more likely to fan the flames and at high load levels insulated pockets can build up excess amounts of heat.

Test Summary

Figure 2:
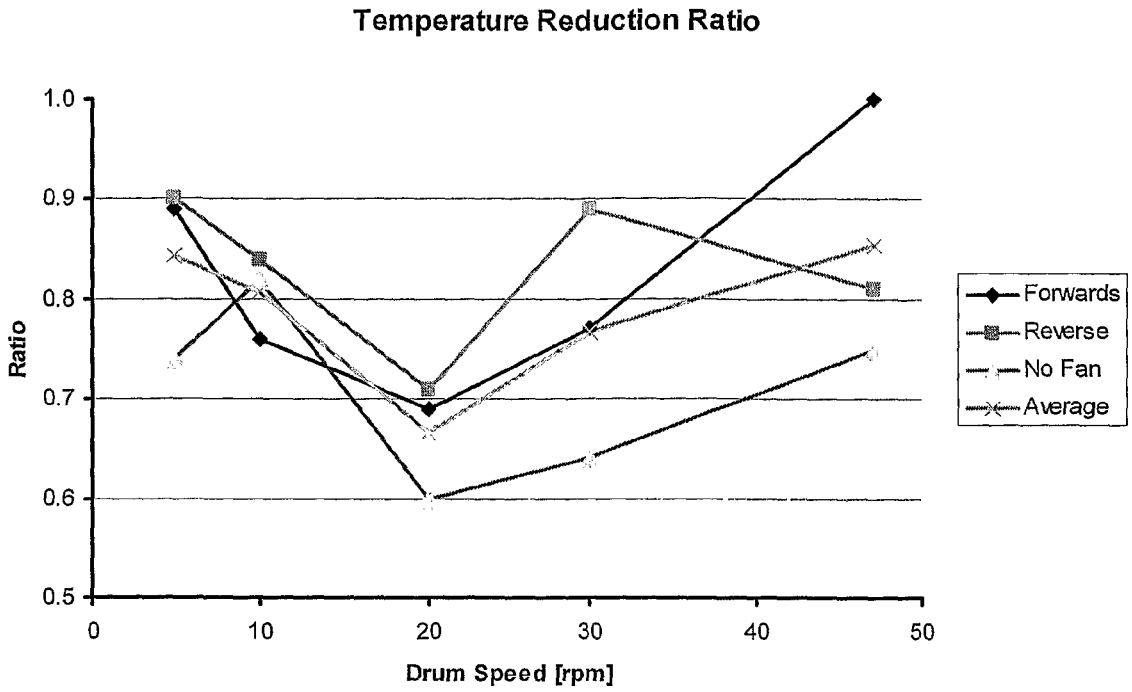
FIG. 2 is a graph of the reduction ratio of temperature vs. rpm of the drum, for various fan configurations.

Typical temperature data measured throughout the tests followed a pattern where upon ignition the temperature began to rise steadily. Once the door/drum was closed the temperature began to rise more rapidly and peaked shortly after starting rotation. For the rest of the 10 minutes test duration the temperature slowly reduced back towards ambient. From the method 2 test data, the difference between the ambient temperature and the peak temperature as well as the difference between ambient and the end temperature was calculated. These values were then expressed as a ratio (end temp/peak temp) and plotted against drum speed for each of the fan configurations in order to identify a general trend. These results are presented in FIG. 2. It can be seen that for the type of machine geometry tested, that the most effective rotation speed was 20 rpm which resulted in the lowest ratio of end temperature to peak temperature.

The invention claimed is:

1. A laundry appliance comprising:

a rotatable laundry holding drum, rotatable about a substantially non-vertical axis, a motor, connected directly or indirectly with said drum to drive rotation of said drum, a controller configured to control operation of said motor to rotate said drum at a first tumbling speed during normal operation, at least one sensor for sensing an abnormal fault condition, and initiating a fault signal in response thereto, said controller configured to receive said fault signal and in response energize said motor to cause said drum to rotate at a second predetermined tumbling speed that is lower than said first tumbling speed, said second predetermined tumbling speed being capable of tumbling a textile load within the drum.

2. A laundry appliance as claimed in claim 1, wherein said appliance includes a fan for moving a flow of air through the interior of said drum, and said controller is further configured to de-activate said fan in response to a said fault signal.

3. A laundry appliance as claimed in claim 1, wherein said appliance includes a fan directly coupled to said drum for moving a flow of air through the interior of said drum, and said fan is operable in a high flow direction and a low flow direction, and wherein said rotation of said drum at said second tumbling speed is in said low flow direction.

4. A laundry appliance as claimed in claim 1, wherein said second tumbling speed is such that a textile load within said drum is caused to tumble at a rate significantly slower than a maximum tumbling speed of said drum.

5. A laundry appliance as claimed in claim 4, wherein said second tumbling speed is between approximately 10 rpm and approximately 35 rpm.

6. A laundry appliance as claimed in claim 4, wherein said second tumbling speed is approximately 20 rpm.

7. A laundry appliance as claimed in claim 1, wherein said appliance further includes a heater, and said controller is further configured to de-energise said heater as said drum is rotated at said second tumbling speed.

8. A laundry appliance as claimed in claim 1, wherein said controller in response to receiving said at least one fault signal, terminates a current cycle and starts a fire containment cycle which causes said motor to rotate said drum at said second tumbling speed.

9. A laundry appliance as claimed in claim 1, wherein said at least one sensor includes a smoke detector, and said abnormal fault condition is the presence of smoke proximate to said detector.

10. A laundry appliance as claimed in claim 1, wherein said at least one sensor includes a temperature sensor, and said abnormal fault condition is a temperature greater than a predetermined threshold temperature proximate to said temperature sensor.

11. A laundry appliance as claimed in claim 10, wherein said at least one sensor is located proximate an exhaust passage, said exhaust passage being in fluid connection with said drum.

12. A laundry appliance as claimed in claim 10, wherein said at least one sensor is located proximate to an inlet of said exhaust passage, and said predetermined threshold temperature is approximately 70° C.

13. A laundry appliance as claimed in claim 10, wherein said predetermined threshold temperature is between approximately 70° C. and 100° C.

14. A laundry appliance as claimed in claim 11, wherein, said at least one sensor is located proximate to an outlet of said exhaust passage, and said predetermined threshold temperature is between approximately 50° C., and approximately 80° C.

15. A laundry appliance as claimed in claim 10, wherein said appliance includes a top deck and said at least one sensor is located in said top deck of said appliance, and said predetermined threshold temperature is between approximately 80° C. and approximately 110° C.

16. A laundry appliance as claimed in claim 10, wherein said threshold temperature is a predetermined temperature difference between a temperature measured by said at least one sensor and ambient temperature.

17. A laundry appliance as claimed in claim 1, wherein said appliance measures and stores temperature data and time elapsed data of a current cycle, and said fault signal is generated by comparing said current cycle data, to stored reference data and generating said signal if said current cycle data deviates from said stored reference data by a predetermined degree.

18. A laundry appliance as claimed in claim 9, wherein said at least one sensor is located on an underside of a lid or cover of said appliance.

19. A laundry appliance as claimed in claim 1, wherein said laundry appliance further includes an audible alarm, and wherein said controller is configured to energise said alarm in response to receiving said fault signal.

20. A laundry appliance as claimed in any one of claims 12 to 16, wherein said appliance includes at least one further sensor to sense further appliance condition parameters, and said control is capable of receiving a signal from said further sensor, said signal being representative of said appliance condition parameters, and said predetermined threshold depends on said sensed appliance condition parameters.

21. A laundry appliance as claimed in claim 20, wherein said appliance condition parameters are any one of:

d) a door or lid of said appliance is open or closed e) said drum is open or closed f) ambient temperature.

22. A method of reducing a risk of fire in a laundry appliance comprising:

sensing a parameter related to increased fire risk within said appliance, determining if said parameter reaches a predetermined threshold, said threshold being indicative of an increased fire risk within said appliance, and if said parameter reaches said threshold, energizing a motor to cause the rotation of a laundry drum of said appliance at a predetermined rotational speed capable of tumbling a laundry load within said drum, and wherein said predetermined rotational speed is less than a normal tumbling speed when said appliance is in a normal operation mode.

23. A method of reducing a risk of fire as claimed in claim 22, wherein said appliance includes a fan for moving a flow of air through said drum and said method further includes deactivating said fan.

24. A method of reducing a risk of fire as claimed in claim 22, wherein said appliance includes a heater for heating a flow of air moving though said drum and said method further includes de-energising said heater.

25. A method of reducing a risk of fire as claimed in claim 22, wherein said appliance includes a fan directly coupled to said drum for moving a few of air through said drum, wherein said fan has a high flow direction and a low flow direction, and said rotation of said drum at said tumbling speed is in a reverse direction.

26. A method of reducing a risk of fire as claimed in claim 22, wherein said pre-determined rotational speed is such that a textile within said drum is caused to tumble at a rate significantly slower than a maximum tumbling speed of said drum.

27. A method of reducing a risk of fire as claimed in claim 22, wherein said pre-determined tumbling speed is between approximately 5 rpm and approximately 30 rpm.

28. A method of reducing a risk of fire as claimed in claim 22, wherein sensing of a said parameter related to increased fire risk comprises sensing the presence of smoke, or other combustion products.

29. A method of reducing a risk of fire as claimed in claim 22, wherein said sensing of a said parameter related to increased fire risk comprises measuring a temperature.

30. A laundry appliance as claimed in claim 1, wherein said appliance controller continues to monitor for said fault signal, when in a standby mode, and causes said motor to rotate said drum at said second predetermined tumbling speed in response to receiving said fault signal.

31. A method of reducing a risk of fire as claimed in claim 22, wherein said step of sensing a parameter related to increased fire risk within said appliance is performed while said appliance is in a standby mode and is not operating.

32. A laundry appliance as claimed in claim 1, wherein at least one sensor includes a combustion product sensor, and said abnormal fault condition is the presence of a combustion product proximate to said sensor.

* * * * *